US005762483A

United States Patent [19]

Lifson et al.

[11] Patent Number: 5,762,483

[45] Date of Patent: Jun. 9, 1998

[54] SCROLL COMPRESSOR WITH CONTROLLED FLUID VENTING TO BACK PRESSURE CHAMBER

[75] Inventors: Alexander Lifson, Manlius; James W. Bush, Skaneateles, both of N.Y.

[73] Assignee: Carrier Corporation, Farmington, Conn.

[21] Appl. No.: 789,933

[22] Filed: Jan. 28, 1997

[51] Int. Cl.[6] ..... F01C 1/04; F04C 18/04

[52] U.S. Cl. ..... 418/55.5; 418/57

[58] Field of Search ..... 62/196.1; 418/55.5, 418/57, 54, 55.4, 55.6, 77, 157, 180

[56] References Cited

U.S. PATENT DOCUMENTS

| | | | |
|---|---|---|---|
| 3,924,977 | 12/1975 | McCullough | 418/55 |
| 4,343,599 | 8/1982 | Kousokabe | 418/55 |
| 4,384,831 | 5/1983 | Ikegawa et al. | 418/55 |
| 4,645,437 | 2/1987 | Sekashita et al. | 48/55.5 |
| 4,669,962 | 6/1987 | Mizuno et al. | 418/55.5 |
| 4,989,414 | 2/1991 | Murayama et al. | 62/228.4 |
| 4,992,032 | 2/1991 | Barito et al. | 418/55.4 |
| 5,520,526 | 5/1996 | Fujio | 418/55.4 |

*Primary Examiner*—William Doerrler

*Attorney, Agent, or Firm*—Howard & Howard

[57] ABSTRACT

An improved control over the pressure vented or tapped to a back pressure chamber in a scroll compressor is achieved by maintaining a vent hole closed for the majority of the operational cycle of the scroll compressor. The hole is preferably selectively exposed to a discharge pressure for a small portion of the cycle, and to an intermediate pressure for a second small portion of the cycle. Other than those two small portions, the hole is preferably closed. The invention reduces pulsation in the back pressure chamber and also reduces pumping losses caused by fluid moving into and out of the back pressure chamber through the hole. In one embodiment, grooves are formed in the fixed scroll member to communicate a selected intermediate pressure and a discharge pressure to locations on the base plate of the fixed scroll member. A vent hole in the wrap of the orbiting scroll member cyclically moves over the two grooves. The vent hole is closed by the base plate of the fixed scroll member for the majority of its operational cycle. In a second embodiment, a pair of holes are formed through the base plate of one of the scroll members. The holes are covered by the wrap of the other scroll member for the majority of the operational cycle of the scroll compressor. Each hole is open for a small portion of the operational cycle to selectively tap an intermediate and discharge pressure to the back pressure chamber.

20 Claims, 7 Drawing Sheets

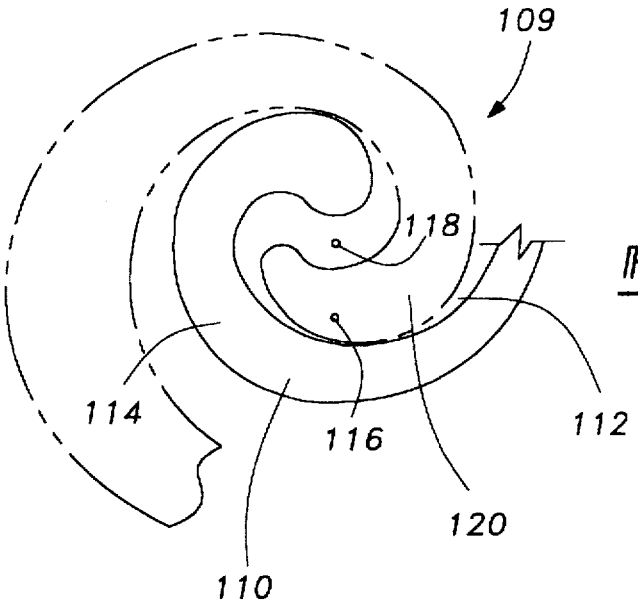
Fig-7A
Fig-7B
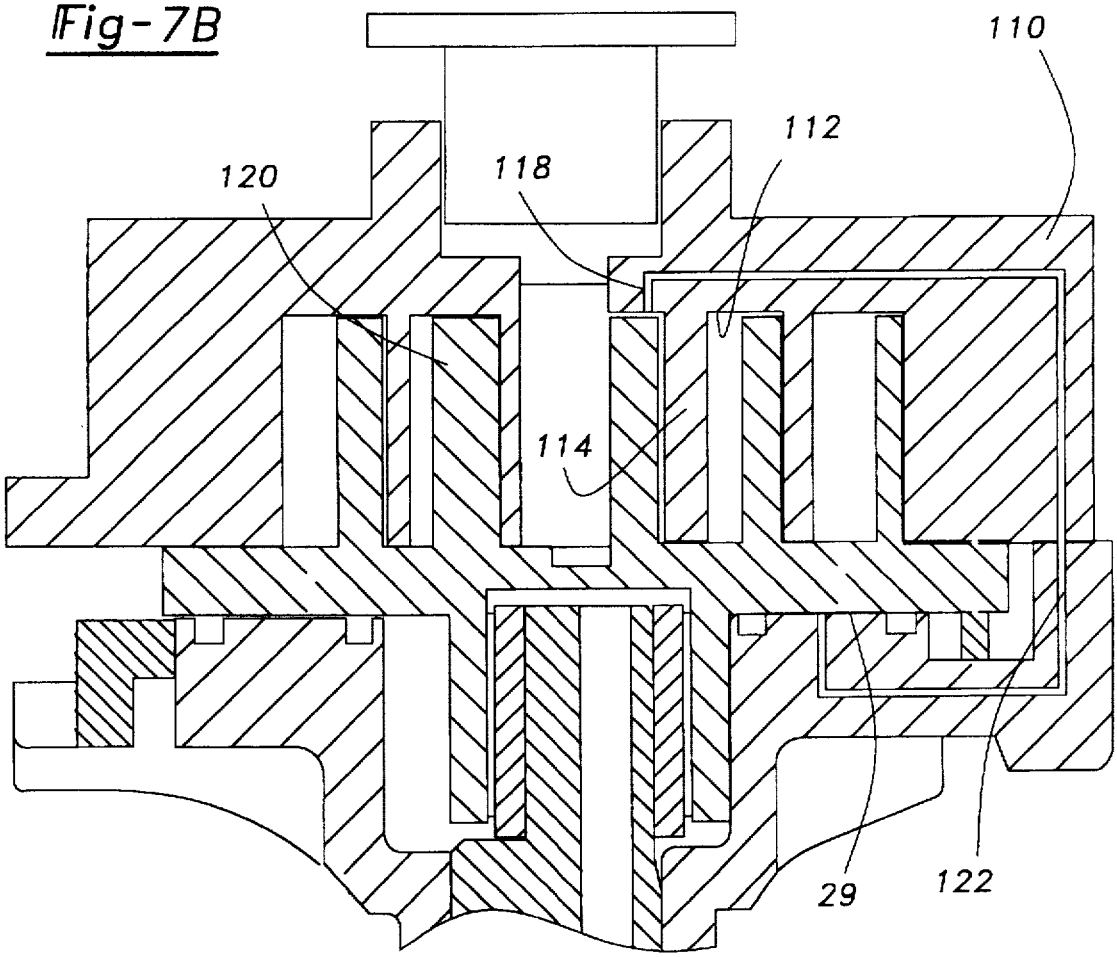

SCROLL COMPRESSOR WITH CONTROLLED FLUID VENTING TO BACK PRESSURE CHAMBER

BACKGROUND OF THE INVENTION

This invention relates to improved scroll compressors wherein the pressure of fluid vented to a back pressure chamber is controlled and optimized.

Scroll compressors are becoming widely utilized in many air conditioning and refrigeration compressor applications. Some of the main benefits from scroll compressors are that they are relatively inexpensive and compact. However, scroll compressors do present challenges to achieve stable operation.

A known scroll compressor is illustrated in FIG. 1A. Scroll compressor 20 includes an orbiting scroll member 22 driven by a shaft 24. A fixed scroll member 26 has a helical scroll wrap 28 extending from a base plate and interfitting with a helical scroll wrap 27 extending from a base plate of orbiting scroll member 22. A discharge port 23 receives the compressed fluid. A back pressure chamber 29 is defined by a pair of seals 30 and 32 and a crank case 33. A vent hole 34 taps fluid from pressure chambers defined between the scroll wraps 27 and 28 to the back pressure chamber 29. The fluid tapped to back pressure chamber 29 is utilized to counteract a separating force created near the center axis of the orbiting scroll member 22 which tends to axially separate the orbiting and fixed scroll members 22 and 26. The force developed in the back pressure chamber 29 opposes this separating force, and maintains the orbiting scroll member 22 biased toward the fixed scroll member 26.

There are some deficiencies in this standard type of scroll compressor. In particular, the vent hole 34 is generally open to the pressure chambers defined between the scroll wraps 27 and 28 through the majority of the orbiting cycle of the orbiting scroll wrap 22. Thus, vent hole 34 communicates varying and pulsating pressures to back pressure chamber 29.

As shown in FIG. 1B, in any one pressure chamber, the pressure developed between the scroll wraps 27 and 28 varies during the operating cycle. The pressure increases from a low or suction pressure 41 to a high or discharge pressure 42. An intermediate pressure ramp 43 extends from the suction pressure 41 to the high pressure 42. The prior art vent hole 34 is typically exposed to intermediate pressure along a portion of ramp 43 and a portion of the high pressure 42. This period of exposure is illustrated by envelope region 47. Occasionally, the fixed scroll wrap 28 passes over hole 34 closing it momentarily. This closure is typically incidental and for a limited time. Thus, during the operational cycle of the scroll compressor, the pressure in the back pressure chamber 29 pulsates and may vary dramatically. This becomes particularly acute in high pressure ratio scroll compressor applications. That is, if the pressure ratio between low pressure 41 and discharge pressure 42 is relatively great, then the amount of pressure pulsation increases dramatically. Scroll compressors are now being considered for high pressure ratio applications. Thus, it can be expected that a good deal of pulsation would occur in the back pressure chamber 29 with the prior art venting.

Pulsation in the back pressure chamber has been found to result in back pressure chamber seal failure, and unstable operation. The pulsation results in a varying back pressure force to oppose the separating force between the orbiting and fixed scroll members. The varying force may not always successfully resist the separating force, particularly when the back chamber pressure is at a low point of the pulsation.

Another problem with the prior art is that pulsating pressures result in a relatively high amount of pumping losses from the pressurized fluid moving back and forth from the pressure chambers to the back pressure chamber. This pressure loss can be on the order of a few percentage points of the overall efficiency of the compressor, and thus is undesirable.

It is generally desirable to have a higher back pressure force resisting the separating force. However, it is also desirable to have some intermediate pressure in the back pressure chamber. Thus, locating the vent hole 34 only near the center of the scroll member such that it sees only relatively high discharge pressure may not always be fully desirable.

Other complications with regard to scroll compressors are found in particular applications. In some applications, a valve may be placed on the discharge port 23. The valve is selectively opened and closed in response to a discharge pressure 44 that is increased dramatically above an uppermost point 45 of the intermediate pressure ramp 43. When this occurs, pressures along the intermediate pressure ramp that are closer to the lower pressure range become particularly undesirable for use in back pressure chamber 29.

In other applications, point 45 may actually be higher than the discharge pressure 46. In these applications, eliminating the intermediate pressure altogether would be undesirable, as there are portions near the point 45 which are actually the highest operational pressures for the particular compressor application.

Thus, the problem of achieving optimum back pressure is not easily solved with the prior art vent hole.

SUMMARY OF THE INVENTION

The present invention overcomes the challenges in the prior art by developing a scroll compressor wherein the vent hole is only uncovered for a small portion of the operational cycle of the scroll compressor. The vent hole is effectively closed over the majority of the operational cycle of the scroll compressor. With this invention, a designer can ensure the vent hole is exposed to an optimum selection of intermediate and discharge pressures, which is communicated to, and maintained in, the back pressure chamber. Pressure pulsations are also reduced. In addition, with the reduction of the pulsation, the pumping losses found in the prior art are also reduced dramatically.

In a disclosed embodiment of this invention, the tapping or venting system is configured such that it selectively vents the fluid to the back pressure chamber from the pressure chambers at an intermediate pressure over a small portion of the cycle, and then vents the fluid at the discharge pressure over a separate small portion of the cycle. The vent hole is preferably closed between the tapping of the intermediate pressure portion and the discharge pressure portion. In this way, the system is able to achieve beneficial results by carefully selecting a desirable location and duration for tapping intermediate pressure and a desirable location and duration for tapping discharge pressure.

In one embodiment of this invention, the vent hole extends through the tip of the scroll wrap of the orbiting scroll. The hole is closed or abuts an end face of the base of the fixed scroll for the majority of its operational cycle. However, for a relatively small portion of its cycle it is exposed to an intermediate pressure. It is then again closed for a period of time, and then exposed to a discharge pressure for a small portion of its cycle.

In a preferred embodiment, grooves are formed in the base plate of the fixed scroll to tap the discharge and intermediate pressure to a location where they are periodically communicated to the vent hole in the orbiting scroll wrap as the orbiting scroll wrap moves relative to the fixed scroll wrap.

In other embodiments of this invention, the vent holes are formed through the base plate of the orbiting or fixed scrolls. The scroll wrap of the other scroll member is positioned over the vent hole for the majority of the operational cycle of the scroll compressor. However, the vent hole is opened for a small portion of the cycle of the scroll compressor where it would be exposed to an intermediate pressure, and also for a small portion where it would be exposed to a discharge pressure. In a most preferred embodiment of this aspect of the invention, there are actually two vent holes utilized, both being in communication with the back pressure chamber and with one being periodically communicated to intermediate pressure and the other being periodically communicated to discharge pressure.

These and other features of the present invention will be best understood from the following specification and drawings, of which the following is a brief description.

BRIEF DESCRIPTION OF THE DRAWINGS

FIG. 7A shows a third embodiment of the present invention.

FIG. 7B shows further detail of the third embodiment.

DETAILED DESCRIPTION OF A PREFERRED EMBODIMENT

Figure 1A:
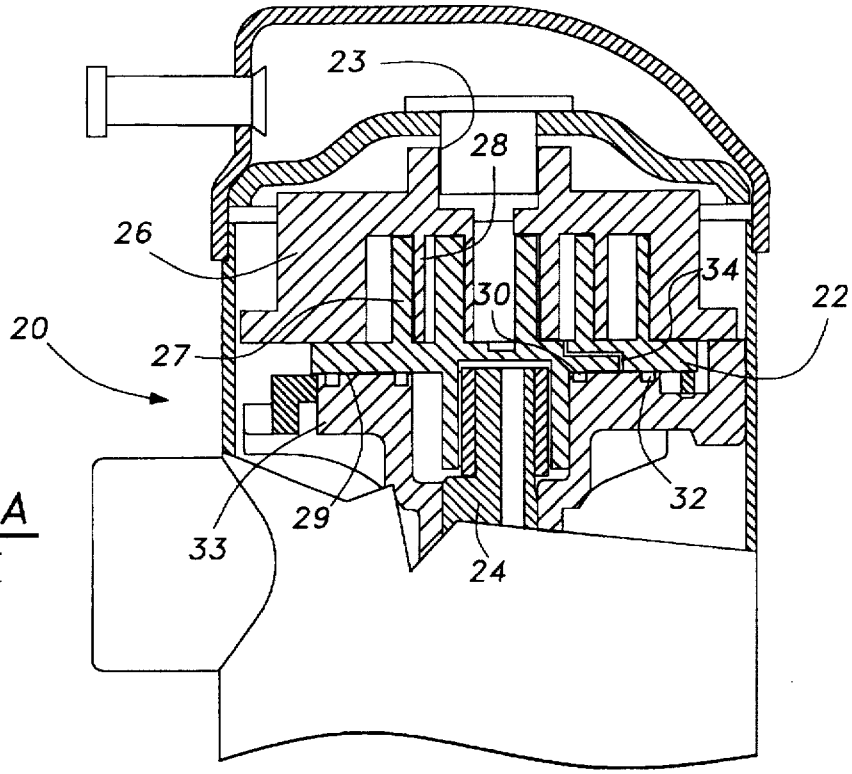
Fig-1A Prior Art
FIG. 1A shows a prior art scroll compressor.
Figure 2:
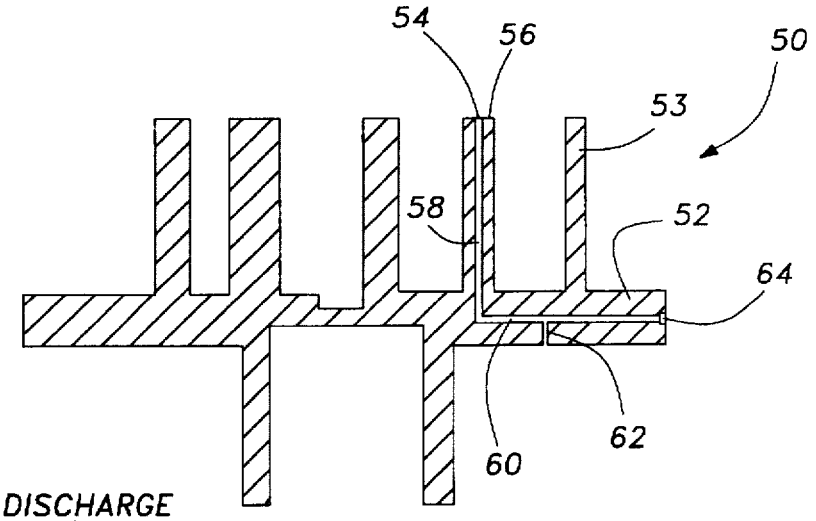
FIG. 2 shows an inventive orbiting scroll according to a first embodiment of the present invention.
Figure 1B:
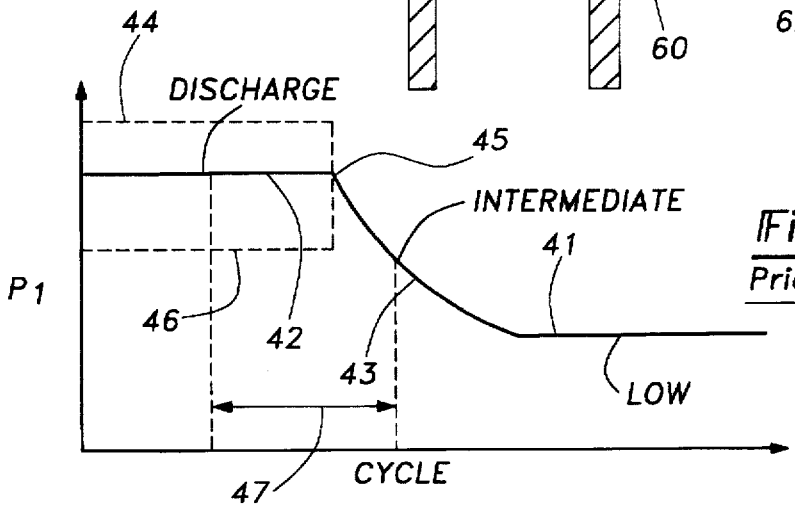
Fig-1B Prior Art
FIG. 1B is a graph showing the pressures encountered during a typical cycle of the prior art scroll compressor.

An orbiting scroll 50 shown in FIG. 2 incorporates a base plate 52 having a scroll wrap 53 extending from base plate 52. A vent hole 54 is formed through a tip 56 of the wrap 53. Vent hole 54 communicates with a bore 58 leading to a cross bore 60 extending through the base 52 to a tap hole 62. Hole 62 communicates with a back pressure chamber 29 as in the prior art. A plug 64 closes the bore 60 at an end of base 52.

Figure 3:
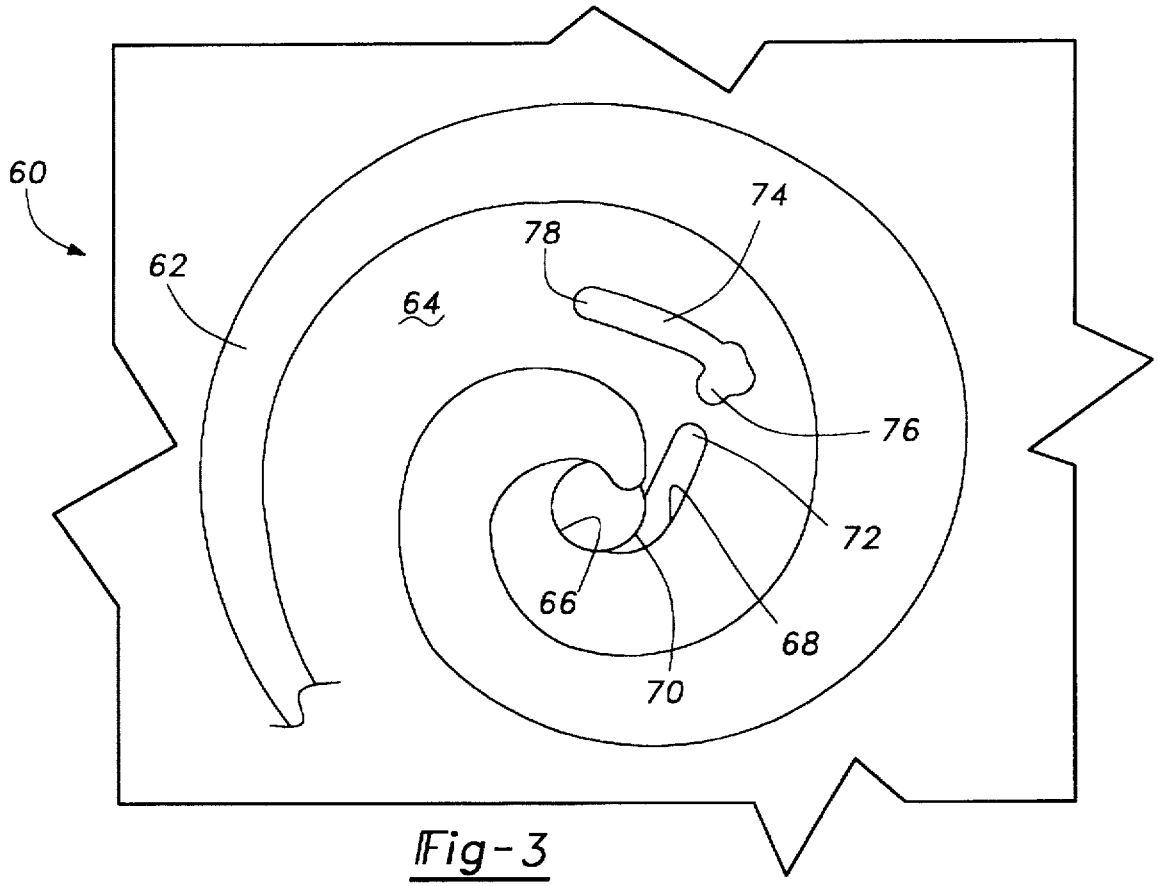
FIG. 3 shows a center portion of a fixed scroll utilized with the first embodiment of the present invention.

FIG. 3 shows a center portion of the wrap of a fixed scroll member 60 which is preferably utilized with the orbiting scroll member 50. A wrap 62 extends from a base plate 64. The discharge port 66 is found generally at a center location on base plate 64. A first high pressure tap groove 68 extends from an end 70 which communicates with the discharge port 66 to a remote end 72. An intermediate pressure groove 74 extends from an end 76 positioned adjacent the end 72 of groove 68 to a remote end 78. The grooves 68 and 74 could be replaced by tap holes to tap the fluid to the locations of the groove ends on the base plate.

The operation of the present invention will now be explained with reference to FIGS. 4A–4G. As known, the orbiting scroll orbits through repeating cycles relative to the fixed scroll. The position of vent hole 54 during discrete steps in each cycle will be explained with reference to FIGS. 4A–4G.

Figure 4A:
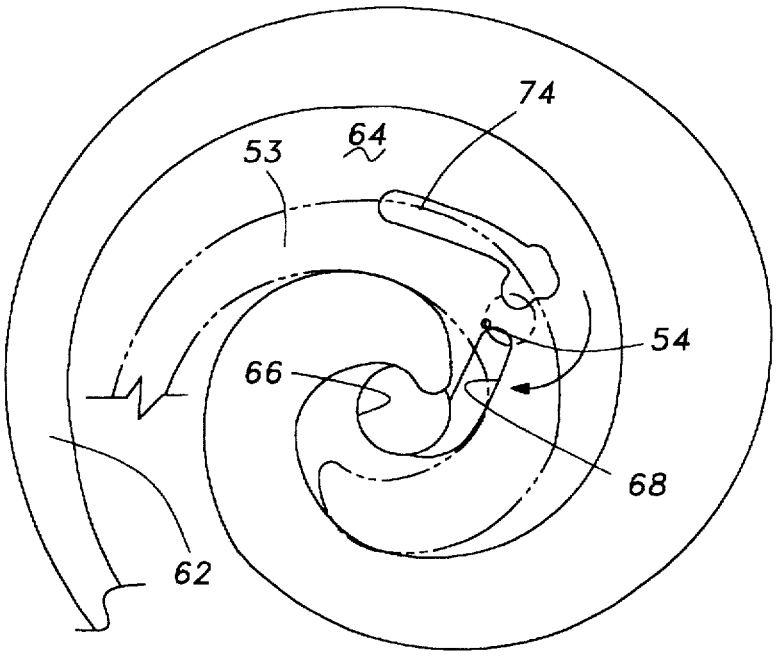
FIG. 4A shows a first step during the cycle of the first embodiment of the present invention.
Figure 4B:
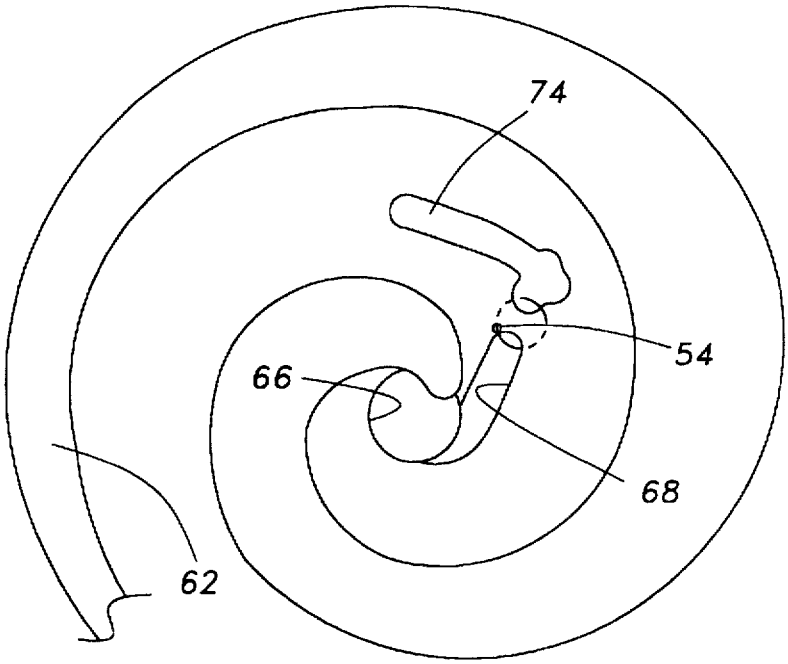
FIG. 4B shows the step shown in FIG. 4A with the orbiting scroll wrap removed for clarity.

As shown in FIG. 4A, the orbiting scroll wrap 53 and vent hole 54 are shown on top of the fixed scroll 60. The vent hole 54 is shown aligned with the base plate 64, and out of communication with both grooves 68 and 74. At this point, the close spacing between the wrap 53 and the base plate 64 will provide a high resistance to flow entering the vent hole 54. Thus, the fluid previously captured in the back pressure chamber 29 remains, and the prior art pulsation and pumping losses are eliminated during this portion of the cycle. Note that in this figure, the groove 74 is shown communicating to an intermediate pressure radially outwardly of the wrap 53. Groove 68 constantly communicates to discharge pressure through the discharge port 66. However, neither pressure is able to communicate with the vent hole 54, since the vent hole 54 is not aligned with either groove 68 or 74. FIG. 4B shows an operational point similar to that shown in FIG. 4A, but with the orbiting scroll wrap 53 removed for clarity. The vent hole 54 is shown at a position approximately equal to that shown in FIG. 4A.

Figure 4C:
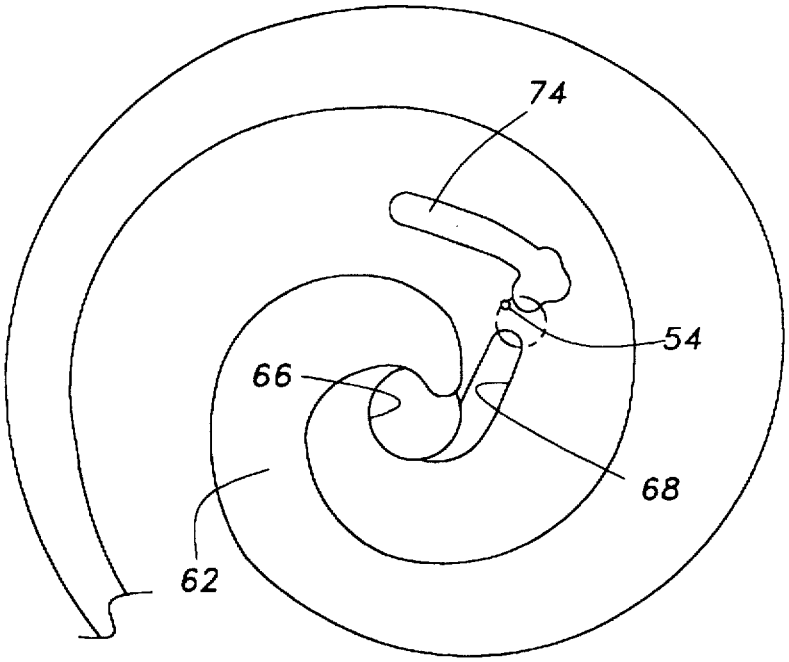
FIG. 4C shows a subsequent step.

FIG. 4C shows a step slightly further along in the operational cycle of the scroll compressor of this embodiment. The tap hole 54 is still not communicating with either groove 68 or 74.

Figure 4D:
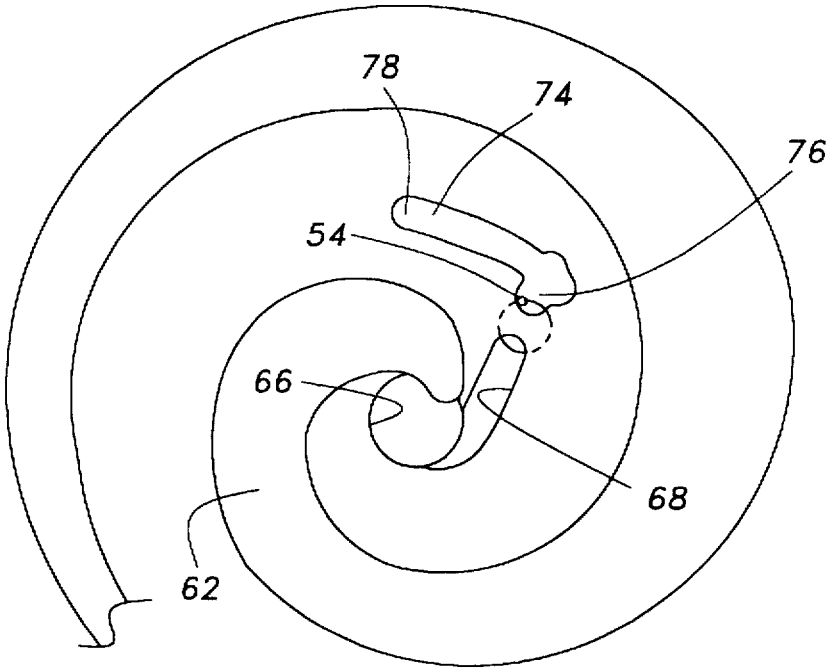
FIG. 4D shows a subsequent step.

FIG. 4D shows a point somewhat subsequent to that shown in FIG. 4C. Vent hole 54 now communicates with the inner end 76 of the groove 74. An intermediate pressure fluid is now tapped from groove end 78 to portion 76, and then through the vent hole 54 to the back pressure chamber. End portion of the groove 74 is not covered by the orbiting scroll wrap at this point such that it can communicate an intermediate pressure to end 76. The location where the intermediate pressure is tapped to the portion 76 at this cyclical point can be controlled such that the particular intermediate pressure desired for the particular scroll compressor can be carefully selected. As an example, in some applications it may be desirable to have an intermediate pressure that is as high as possible tapped to vent hole 54. In such instances, the shape of the groove 74 is designed such that when the vent hole 54 is in the location shown in FIG. 4D, the intermediate pressure exposed to the groove 74 is from the highest intermediate pressure point. A worker of ordinary skill in the art would be able to recognize these features of the present invention, and design the grooves 74 according to the particular desired operational features of the particular scroll compressor.

Figure 4E:
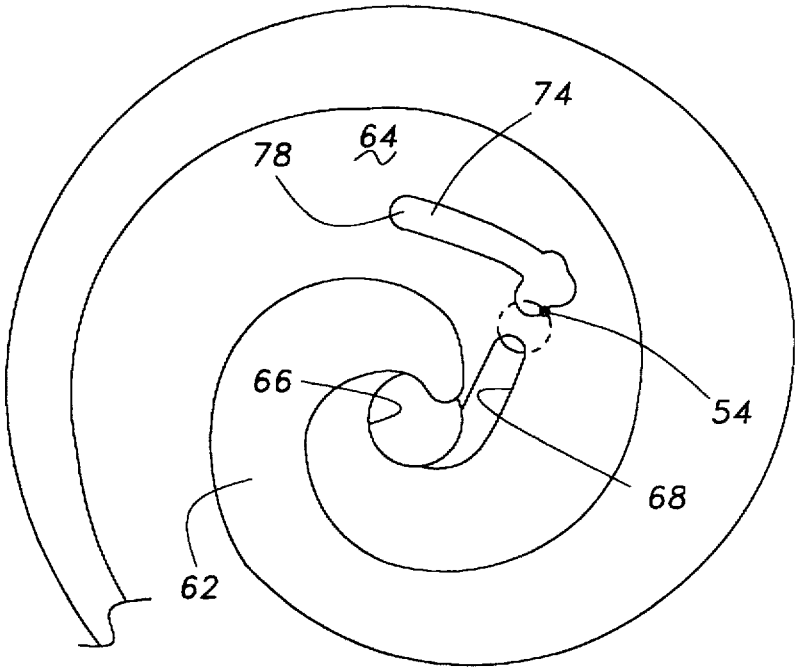
FIG. 4E shows a subsequent step.

FIG. 4E shows a step somewhat subsequent to that shown in FIG. 4D. At this point, vent hole 54 is about to move out of communication with the groove 74 by moving beyond the end 76.

Figure 4F:
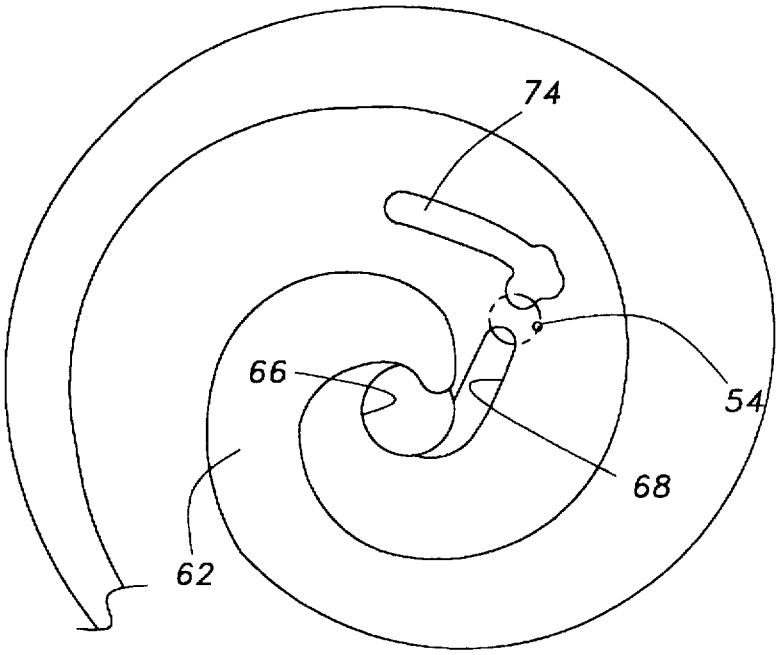
FIG. 4F shows a subsequent step.

As shown in FIG. 4F, vent hole 54 is now out of communication with both grooves 74 and 68. At this point, the vapor in the back pressure chamber 29 is captured and maintained. Again, pulsation and pumping losses are eliminated for this portion of the cycle.

Figure 4G:
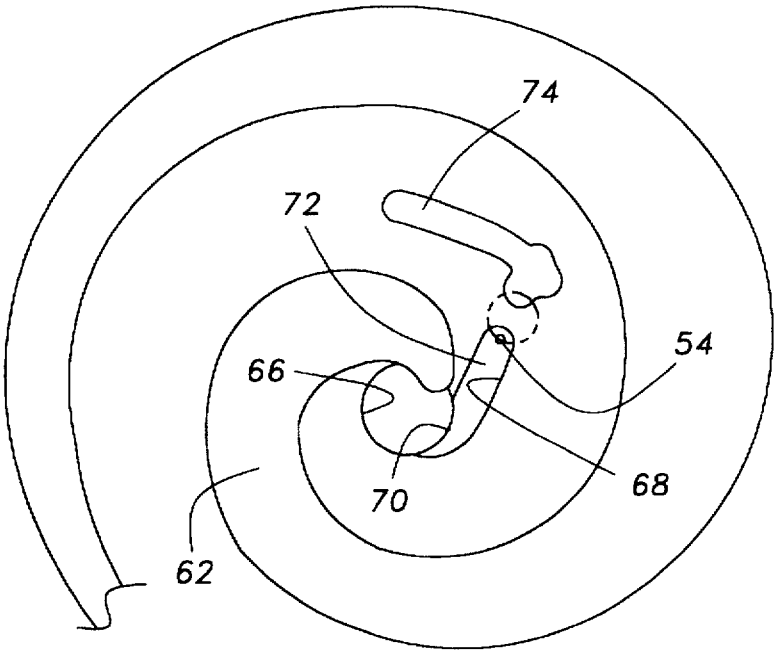
FIG. 4G shows a subsequent step.

As shown in FIG. 4G, the scroll compressor has moved beyond the position shown in FIG. 4F. At this point, vent hole 54 is now in communication with the end 72 of the groove 68. At this point, discharge pressure from the discharge port 66 communicates from end 70 to end 72, through tap hole 54, and into back pressure chamber 29.

From the position shown in FIG. 4G, the compressor returns to the position shown in FIGS. 4A and B. The vapor previously tapped from the discharge port is captured and maintained in the back pressure chamber 29.

Figure 5:
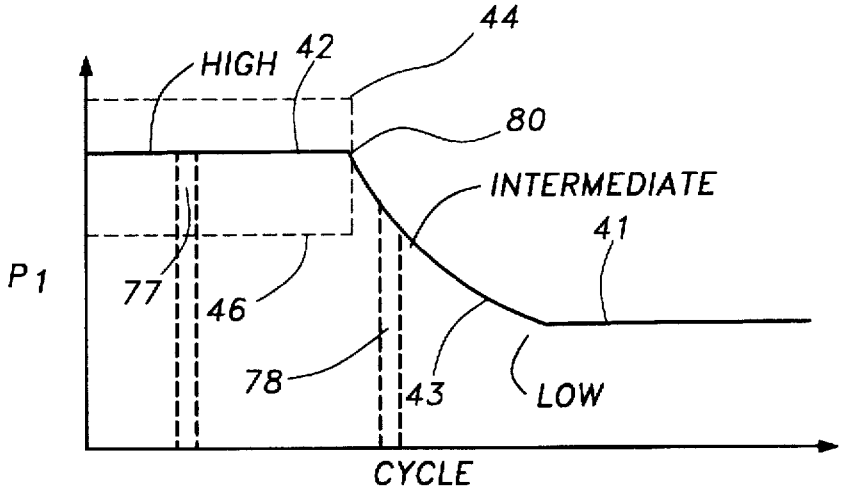
FIG. 5 is a graph similar to FIG. 1B, but showing the first embodiment of the present invention.

The present invention allows a designer to carefully control the pressures in back pressure chamber 29. FIG. 5 shows the pressure of a pressure chamber during one cycle of the present invention. As shown, the designer could carefully capture vapor at various pressures as desired for the particular scroll compressor in the two small envelope regions 77 and 78. Thus, the designer is able to capture vapor at a discharge pressure over envelope region 77 and also capture vapor over a small envelope region 78 at a desirable intermediate pressure.

The force tending to separate the scrolls, and against which the back chamber force is intended to act, is dependent in part on the intermediate pressure ramp 43 and is part on the discharge pressure 42 (or 44 or 46 as it may vary). It is thus desirable and necessary for the back chamber pressure and its resultant force to be dependent on and independently responsive to those two pressure components. Proper selection of the widths of envelope regions 77 and 78, which determine the amount of time the vent 54 is exposed to groove ends 72 and 76 respectively, as well as selection of the location of envelope region 78 on intermediate pressure ramps 43 and of the area of back chamber 29 all can result in tailoring of the back chamber pressure and its resulting force to optimally act against and respond to changes in the scroll separating force. In several applications, a higher average pressure in envelope region 78 will result in a higher average pressure in the back chamber 29 with no loss in responsiveness to the magnitude of intermediate pressure ramp 43. The higher average pressure means that the back chamber area may be reduced for a given magnitude of back chamber force and thus the overall size of the compressor may be reduced. Thus, it may often be desirable to locate the envelope region 78 as close as possible or even adjacent to the highest point 80 of the intermediate pressure ramp 43. A designer can determine all these goals for a particular scroll compressor and properly select the design variable described above for optimum operating characteristics.

Figure 6:
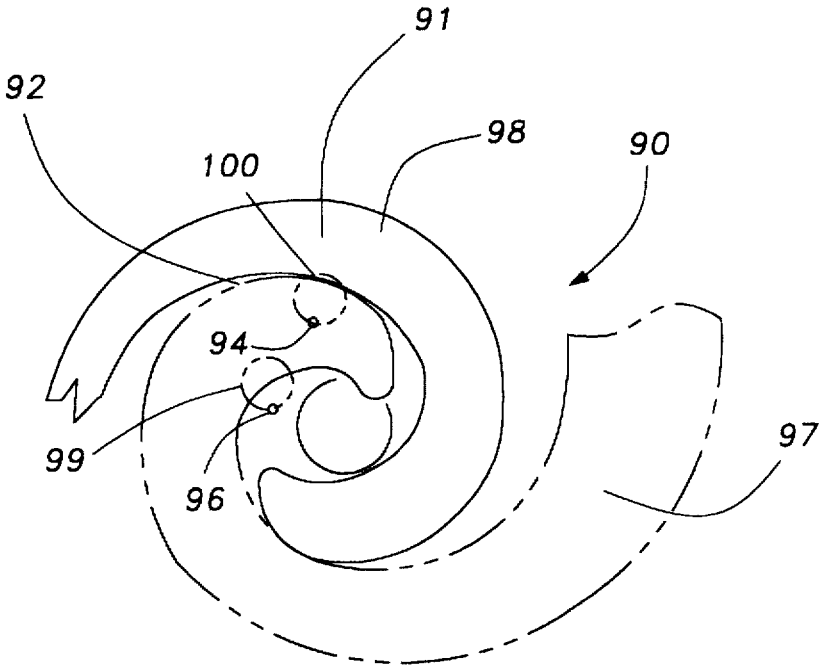
FIG. 6 shows a second embodiment of the present invention.

FIG. 6 shows a second embodiment 90 wherein the orbiting scroll 91 has a base 92 with two pressure taps 94 and 96 formed adjacent a portion of its wrap 98. As shown, the holes 94 and 96 are preferably shown near the inner end of the wrap 98. The fixed scroll 97 is shown in this location covering the tap 94, but exposing the tap 96. The dotted lines 99 and 100 show the movement of the holes 94 and 96 during the orbiting movement of the orbiting scroll wrap 91. As shown, over the majority of the operational cycle hole 94 and hole 96 will be covered by the scroll wrap 97. Hole 96 is in communication with discharge pressure for a small portion of the compression cycle corresponding to envelope region 77 and hole 94 is in communication with intermediate pressure for a small portion of the compression cycle corresponding to envelope 78. Both holes are also in communication with back chamber 29.

The same benefits discussed above are achieved with this embodiment.

FIG. 7A shows another embodiment 109 of the present invention. In embodiment 109, the fixed scroll wrap 110 has a base 112 formed adjacent to wrap 114. Vent holes 116 and 118 are formed through the base 112. The orbiting scroll wrap 120 is shown covering hole 116, but exposing hole 118. During movement of the scroll wrap 120, again, holes 116 and 118 will be periodically exposed to pressure during selected portions of the compression cycle. However, as was the case in the prior embodiments, it is preferred that during the majority of the operational cycle of the scroll compressor of this embodiment, the orbiting scroll wrap 120 cover holes 116 and 118.

FIG. 7B shows further features of the third embodiment shown in FIG. 7A. In this embodiment, it is shown that a fluid communication line 122 extends around and through the fixed scroll wrap 110 to the back pressure chamber 29.

In summary, the present invention discloses a method and apparatus for controlling the fluid tapped or vented to the back pressure chamber of the scroll compressor. In preferred aspects of this invention, the tap occurs over two relatively small portions of the operational cycle of the scroll compressor. During a first portion, an intermediate pressure is tapped to the back pressure chamber. The tap is then closed for a period of the operational cycle of the scroll compressor. A tap is then exposed to a discharge pressure, and then again closed. Thus, the present invention taps fluid at two relatively small, and carefully selected portions of the operational cycle of the scroll compressor to the back pressure chamber. In this way, the operator may eliminate pulsations in the back pressure chamber, pumping losses through the vent holes, and also can carefully control the pressure found in the back pressure chamber.

There are other variations of the specifically disclosed embodiments that could utilize the main features of this invention. As one example, the grooves as shown in FIG. 3 could be placed in the orbiting scroll. A vent hole could be placed in the fixed scroll with a passage arrangement such as shown in FIG. 7. Further, the grooves such as shown in the FIG. 3 embodiment could be utilized with two vent holes through the tip of the orbiting scroll. Each vent hole could communicate with one of the grooves exclusively. Further, when the term "back pressure chamber" is utilized in this application it should be understood that by utilizing three seals one could achieve a pair of sub-chambers which are separated from each other. This type of "dual-chamber" back pressure chamber is still within the scope of this invention. Of course, there are many other variations that can be utilized for achieving the main goals of this invention. The above-described examples are simply the most preferred embodiments at this time.

Although preferred embodiments of this invention have been disclosed, a worker of ordinary skill in the art would recognize that certain modifications would come within the scope of this invention. For that reason, the following claims should be studied to determine the true scope and content of this invention.

We claim:

1. A scroll compressor comprising:

a fixed scroll member having a base plate and a scroll wrap extending from said base plate;

an orbiting scroll member having a base plate and a scroll wrap extending from said base plate, said orbiting scroll member being driven relative to said fixed scroll member through an operational cycle;

said scroll wrap of said orbiting scroll member and said scroll wrap of said fixed scroll member interfitting to define a plurality of pressure chambers;

a back pressure chamber defined on a side of said base plate of said orbiting scroll member remote from said fixed scroll member; and a system for tapping fluid to said back pressure chamber, said system including at least one vent hole selectively exposed to at least one of said pressure chambers during a portion of said operational cycle of said scroll member, and said vent hole being closed for the majority of said operational cycle.

2. A scroll compressor as recited in claim 1, wherein said system has two open portions, with a discharge pressure tapped to said back pressure chamber in a first portion, and a second portion tapping a pressure other than discharge pressure to said back pressure chamber.

3. A scroll compressor as recited in claim 2, wherein said other pressure is an intermediate pressure.

4. A scroll compressor as recited in claim 2, wherein said system includes a first source in said base plate of one of said scroll members to communicate said discharge pressure to a face of said base plate, and a second source to communicate said other pressure to said face of said base plate, said hole being formed in said scroll wrap of the other of said scroll members, and said hole being selectively communicated with said first and said second sources in said base plate of said one scroll member to communicate to said back pressure chamber.

5. A scroll compressor as recited in claim 4, wherein said first and second sources are formed by grooves in said base plate of said one scroll member.

6. A scroll compressor as recited in claim 5, wherein said other scroll member is said orbiting scroll member.

7. A scroll compressor as recited in claim 2, wherein said base plate of one of said fixed and orbiting scroll members has a pair of vent holes extending through said base plate, said holes being selectively covered by said scroll wrap of the other of said scroll members over the majority of the operational cycle of said scroll compressor.

8. A scroll compressor as recited in claim 7, wherein said vent holes are formed in said orbiting scroll member.

9. A scroll compressor as recited in claim 7, wherein said vent holes are formed in said fixed scroll member.

10. A scroll compressor comprising:

a fixed scroll member having a base plate and a scroll wrap extending from said base plate, a first source for communicating a discharge pressure to a portion of said fixed scroll base plate, and a second source for communicating pressure other than discharge pressure to a location on said fixed scroll base plate;

an orbiting scroll having a base and a scroll wrap extending from said base, said orbiting scroll being driven for movement relative to said fixed scroll through an operational cycle;

a back pressure chamber defined on a side of said base plate of said orbiting scroll member remote from said fixed scroll member; and at least one vent hole for tapping pressurized fluid from said first and second sources through said orbiting scroll wrap and to said back pressure chamber.

11. A scroll compressor as recited in claim 10, wherein said first and second sources are provided by grooves formed in said base of said fixed scroll member.

12. A scroll compressor as recited in claim 11, wherein said orbiting scroll wrap has said vent hole formed in a tip, said vent hole being selectively driven to cyclically cross said grooves on said base plate of said fixed scroll member.

13. A scroll compressor as recited in claim 12, wherein a single hole is formed in said orbiting scroll wrap, said single hole alternating between communicating with said first groove, then being closed by said base plate of said fixed scroll member, and communicating with said second source, then being closed by said base plate of said fixed scroll member.

14. A method of operating a scroll compressor comprising the steps of:

(1) providing a fixed scroll member having a base plate and a scroll wrap extending from said base plate, and an orbiting scroll member having a base plate and a scroll wrap extending from said base plate, defining a back pressure chamber on a side of said base plate of said orbiting scroll member remote from said fixed scroll member;

(2) causing said orbiting scroll member to move through an operational cycle relative to said fixed scroll member; and (3) tapping fluid from pressure chambers defined between said scroll wraps of said fixed and orbiting scroll members to said back pressure chamber, said tapping being intermittent, such that said tapping does not occur through the majority of said cycle of said orbiting scroll member.

15. A method as recited in claim 14, including the steps of tapping a discharge pressure to said back pressure chamber, then interrupting said tapping, then tapping a pressure other than discharge pressure to said back pressure chamber, said tapping then being interrupted again, and said tapping then returning to tapping discharge pressure to said back pressure chamber.

16. A method as recited in claim 15, wherein said tapping occurs through the tip of said orbiting scroll wrap.

17. A method as recited in claim 16, wherein a hole in said tip of said scroll wrap selectively communicates with grooves formed in said base plate of said fixed scroll member to provide said tapping.

18. A method as recited in claim 15, wherein there are two holes formed in the base of one of said fixed and orbiting scroll members, said two holes selectively communicating with said discharge and other pressure.

19. A method as recited in claim 18, wherein said holes communicate the fluid through said fixed scroll member.

20. A method as recited in claim 18, wherein said holes communicate fluid through said orbiting scroll member.

* * * * *